US009537216B1

(12) United States Patent
Kontopidis et al.

(10) Patent No.: US 9,537,216 B1
(45) Date of Patent: Jan. 3, 2017

(54) TRANSPARENT ANTENNA

(71) Applicants: George Kontopidis, Sherborn, MA (US); R Brough Turner, Newton, MA (US)

(72) Inventors: George Kontopidis, Sherborn, MA (US); R Brough Turner, Newton, MA (US)

(73) Assignee: Netblazer, Inc., Allston, MA (US)

( * ) Notice: Subject to any disclaimer, the term of this patent is extended or adjusted under 35 U.S.C. 154(b) by 178 days.

(21) Appl. No.: 14/306,541

(22) Filed: Jun. 17, 2014

Related U.S. Application Data

(63) Continuation-in-part of application No. 13/307,400, filed on Nov. 30, 2011, now Pat. No. 8,892,048.

(60) Provisional application No. 61/836,117, filed on Jun. 17, 2013, provisional application No. 61/458,715, filed on Dec. 1, 2010.

(51) Int. Cl.
*H01Q 3/00* (2006.01)
*H01Q 3/36* (2006.01)
*H01Q 21/00* (2006.01)

(52) U.S. Cl.
CPC ..... *H01Q 3/36* (2013.01); *H01Q 21/0006* (2013.01)

(58) Field of Classification Search
CPC ..... H01Q 3/36; H01Q 21/006
USPC ..... 342/368
See application file for complete search history.

(56) References Cited

U.S. PATENT DOCUMENTS 5,608,414 A * 3/1997 Amore ..... B64G 1/22 343/700 MS
5,696,372 A * 12/1997 Grober ..... B82Y 20/00 250/216
2003/0107518 A1* 6/2003 Li ..... H01Q 1/243 343/702
2003/0142018 A1* 7/2003 Lange ..... H01Q 1/007 343/700 MS
2009/0207086 A1* 8/2009 Shinkawa ..... H01Q 1/1271 343/793

* cited by examiner

*Primary Examiner* — Frank J McGue
(74) *Attorney, Agent, or Firm* — Chapin Intellectual Property Law, LLC

(57) ABSTRACT

Antenna arrays can be fabricated as patches on conductive transparent material over an appropriate transparent dielectric substrate with the appropriate transparent ground-plane. To keep the fabrication cost low, such antenna arrays have a planar design without cross-over of the feeding lines or 3D interconnects. To steer the antenna horizontally, patches need to be fed with incremental phase shifts relative to their left or right neighbors; such feeds require an appropriate network and RF switches, typically located in an adjacent non-transparent area such as a PCB. Fabricating and disposing transparent phase delay component on the transparent material reduces the size of the PCB, thereby increasing visible transparent area.

6 Claims, 6 Drawing Sheets

TRANSPARENT ANTENNA

RELATED APPLICATIONS

This application claims the benefit under 35 U.S.C. §119 (e) of U.S. Provisional Patent Application No. 61/836,117, filed Jun. 17, 2013, entitled "FABRICATION TECHNIQUES OF STEERABLE TRANSPARENT ANTENNA ARRAYS," and is a Continuation-in-Part under 35 U.S.C. §120 of U.S. patent application Ser. No. 13/307,400, entitled "TRANSPARENT MULTI-ELEMENT ANTENNA," filed Nov. 30, 2011, which claims the benefit under 35 U.S.C. §119(e) of U.S. Provisional Patent Application No. 61/458,715, filed Dec. 1, 2010, entitled "TRANSPARENT MULTI-ELEMENT ANTENNA", incorporated herein by reference in entirety.

BACKGROUND

Telecommunications requirements in dense, urban areas are often substantial, due to a dense arrangement of business locations in multi-story buildings. Networking resources are typically wired, due to the speed and transmission reliability that such physical interconnections provide. Wireless based communication in urban areas is often hindered by the presence of dense structural materials such as concrete and steel. However, the dense arrangement of window area in substantially opposed orientation (such as across a thoroughfare or street) provides an opportunity for a mesh network of line-of-sight based communications, if the proximate sites are properly managed, as tenancy in such environments is usually widely varied.

SUMMARY

A transparent, phased antenna array unobtrusively occupies existing window area and leverages window space for wireless communication with adjacent transparent or conventional antennas while still permitting visibility and light through the window. The transparent antenna facilitates installation of a wireless mesh network node such as that described in the copending application disclosed above. The transparent antenna positions transmission elements, such as patch antennas, in an optimal location in a window without interfering substantially with the passage of light through the window. A transparent, planar base material such as a plastic sheet contains steerable, beamforming antenna arrays constructed as a row of patch antennas, and transparent traces connect the patch antennas to control electronics including a driving network for generating and receiving signals for transmission. Transparent phase delay elements provide a steering network for phase control on the transparent base without hindering the transparent nature, and relieve the need to dispose phase control electronics in an adjacent PCB board housing the driving network. The phase delay elements may be provided by a Butler array, further simplifying the driving electronics. The adjacent PCB board may be adhered along an edge of the transparent base, however occupies substantially less area than the transparent base so as not to obscure window area. Multiple antenna arrays are provided from a single PCB board by extending linear traces to a distal half of the transparent base, and folding the transparent base such that the distal half overlays a proximate half, thereby forming a double planar surface bisected by the fold. A dielectric substrate and ground plane adhered in a layered manner to the transparent base complement the control electronics in the PCB. The location of the traces and Butler array are staggered such that the patch antennas on each folded half remain unobscured from the trace elements or other patch antennas (patches). In this manner, a transparent, horizontal and vertical polarized phased array system is implemented in a window area that remains substantially unnoticeable by permitting light passage through the transparent base.

In a particular implementation, the multiple polarization, transparent phased antenna as disclosed herein lends itself well to the wireless system described above. The wireless communications system interconnects wireless nodes in or on separate buildings or other structures, typically in an urban environment. High density, high capacity, networks are formed using directional antennas with either fixed aiming or electronic beam forming and beam steering with directional beams used to reduce received interference and significantly increase total capacity (via spatial reuse of available spectrum).

While nodes employing the transparent antennas can be placed anywhere in or around a subscriber's location, nodes are typically located indoors with antennas facing out a window. This puts the wireless nodes within the premises of network participants, simplifying both the decision to participate and the installation. To establish the network, each node should be able to form high capacity communications links with one or more nearby nodes, typically window-to-window. Mounting in or near windows works well because, in general, RF signals are not severely attenuated by ordinary window glass.

The line-of-sight mesh network therefore provides a specialized access medium that is very cost effective by leveraging the local environment of a dense subscriber arrangement having line-of-sight adjacency suitable for antenna-based (i.e. wireless) coupling. One caveat, however, to this arrangement is that each subscriber effectively operates as a transit node for downstream users, and maintains the radio and antenna equipment in such proximity so as to maintain the line of sight adjacency to neighboring nodes.

Accordingly, configurations herein describe a transparent wireless antenna having antenna and radio circuits disposed via transparent microstrips or other transparent conductors on a transparent substrate for nonobstructive hanging in a window having a line of sight to an adjacent node. An additional feature is to steer highly directional beams electronically so the radio/antenna assembly can be hung in a window with no need for manual aiming. The transparent wireless antenna disposes independent antenna elements in an array to create and steer highly directional beams Alternate configurations of the invention include a multiprogramming or multiprocessing computerized device such as a multiprocessor, controller or dedicated computing device or the like configured with software and/or circuitry (e.g., a processor as summarized above) to process any or all of the method operations disclosed herein as embodiments of the invention. Still other embodiments of the invention include software programs such as a Java Virtual Machine and/or an operating system that can operate alone or in conjunction with each other with a multiprocessing computerized device to perform the method embodiment steps and operations summarized above and disclosed in detail below. One such embodiment comprises a computer program product that has a non-transitory computer-readable storage medium including computer program logic encoded as instructions thereon that, when performed in a multiprocessing computerized device having a coupling of a memory and a processor, programs the processor to perform the operations disclosed herein as embodiments of the invention to carry out data access requests. Such arrangements of the invention are typically provided as software, code and/or other data (e.g., data structures) arranged or encoded on a computer readable medium such as an optical medium (e.g., CD-ROM), floppy or hard disk or other medium such as firmware or microcode in one or more ROM, RAM or PROM chips, field programmable gate arrays (FPGAs) or as an Application Specific Integrated Circuit (ASIC). The software or firmware or other such configurations can be installed onto the computerized device (e.g., during operating system execution or during environment installation) to cause the computerized device to perform the techniques explained herein as embodiments of the invention.

BRIEF DESCRIPTION OF THE DRAWINGS

The foregoing and other objects, features and advantages of the invention will be apparent from the following description of particular embodiments of the invention, as illustrated in the accompanying drawings in which like reference characters refer to the same parts throughout the different views. The drawings are not necessarily to scale, emphasis instead being placed upon illustrating the principles of the invention.

DETAILED DESCRIPTION

Configurations herein describe techniques for fabricating a transparent antenna organized as 2×N arrays including corresponding steering networks. Antenna arrays can be fabricated as patches (patch antenna elements) on conductive transparent material over an appropriate transparent dielectric substrate with an appropriate transparent groundplane. To keep the fabrication cost low, such antenna arrays are planar without cross-over of the feeding lines or 3D interconnects. To be able to steer the antenna horizontally, patches need to be fed with incremental phase shifts relative to their left or right neighbors. Such feeds employ an appropriate network and RF switches, typically located in an opaque adjacent portion such as a PCB housing. Configurations herein are based, in part, on the observation that phased array antenna components, such as antenna patches, circuit traces, and phase modification elements can be fabricated in a transparent or substantially transparent form. Unfortunately, conventional approaches to planar mounting of phased array antennas suffer from the shortcoming that multiple rows of antenna patches (i.e. phased arrays) are problematic to feed from one side of the array while avoiding crossover and maintaining trace distances that do not disrupt the phase of the signal transmitted from a driving network on the PCB. Accordingly, configurations below substantially overcome the above described shortcomings by feeding multiple rows of patch antennas arranged in a planar fashion by folding the transparent material behind the ground-plane. Each row defines a phased array for respective horizontal and vertical polarization.

Figure 1:
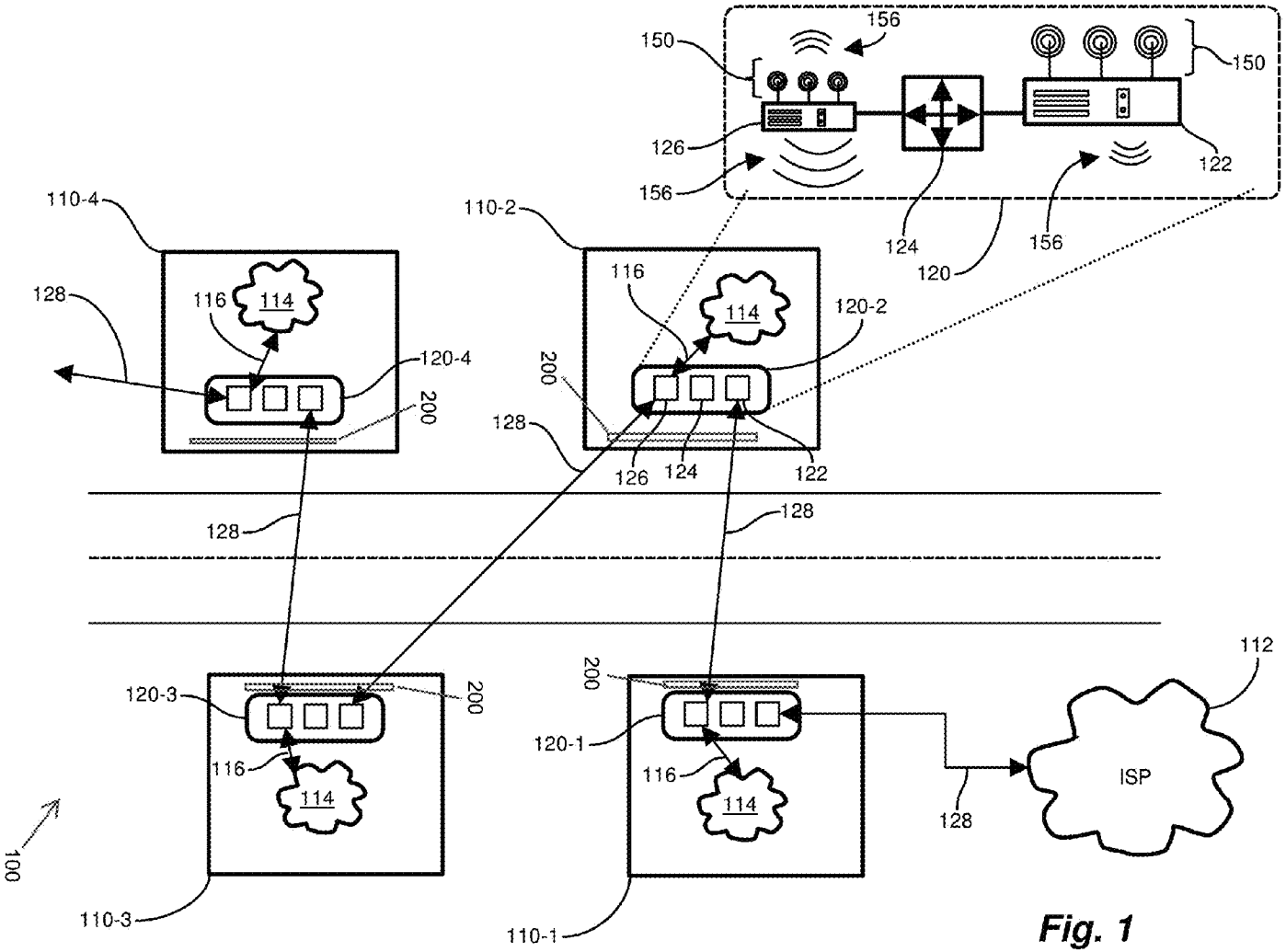
FIG. 1 is a context diagram of a wireless networking environment suitable for use with configurations disclosed herein.

FIG. 1 is a context diagram of a wireless networking environment suitable for use with configurations disclosed herein. Referring to FIG. 1, in the wireless networking environment 100, subscriber sites 110-1 . . . 110-4 (110 generally) receive Internet service from an ISP 112. Each subscriber 110, typically located in an office building or floor/suite thereof, employs a mesh node (node) 120-1 . . . 120-4 (120 generally) for communicating with adjacent nodes in the environment 100. In the first configuration, each node 120 includes at least 2 radios: an upstream radio 122 and a repeater/access point (AP) radio 126, each having a respective antenna 150, and a router 124. Each radio is responsive to at least one wireless link 128 to an adjacent node 122. The radio 122 communicates upstream toward the ISP and the repeater/AP radio 126 transmits downstream to extend the mesh network to additional subscribers. The repeater/AP 126 radio may also serve local clients 114 via a local link 116. Alternatively, the local link 116 may be serviced by a separate radio on order to avoid impacting downstream subscribers 110. In a low cost configuration, one radio and one antenna are multiplexed to provide the functions of radios 122 and 126. This is the configuration discussed further below with a single (multi-element) transparent antenna 200. It should be noted that the transparent antenna 200 provides a multi-element beam forming and phase-array beam steering antenna, is transmit-receive symmetric and is being used with an appropriate RF switch to form the full duplex data transfer system described.

Each of the subscribers 110 has at least one line-of-sight link 128 with an adjacent subscriber 110; in the example shown, adjacent subscribers 110 are across a street, providing a clear path for the links 128. In configurations discussed further below, the antenna 150 is a transparent antenna 200 having conductive elements and circuits thereon for defining the radios of the node. In such configurations, beamforming and beamsteering are employed for directing the wireless signals 156 over the wireless links 128 to an adjacent node 120 via a transparent wireless antenna, discussed further below.

Figure 2A:
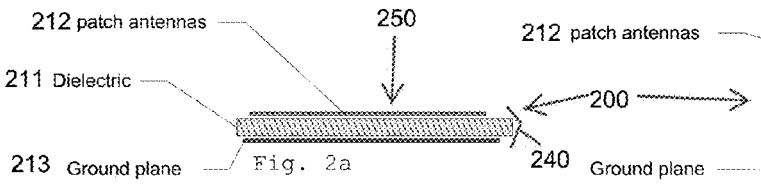
FIGS. 2*a*-2*c* show a layered structure of a transparent antenna as used in the environment of FIG. 1.
Figure 2B:
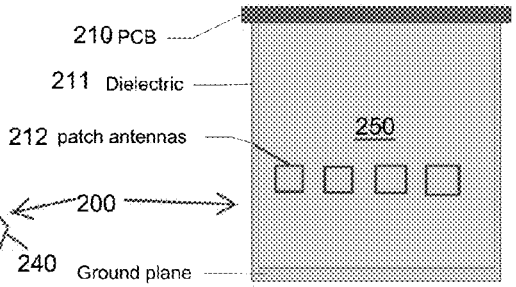
Figure 2C:
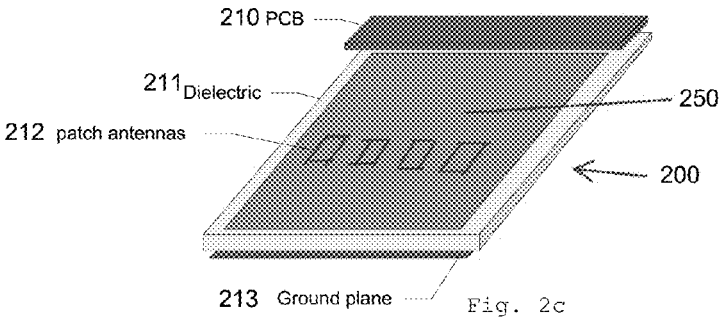

FIGS. 2*a*-2*c* show a layered structure of a transparent antenna as used in the environment of FIG. 1. Transparent phased antennas as disclosed herein are preferable fabricated from stock and/or inexpensive components for maintaining consumer appeal. An inexpensive construction technique of transparent phased antennas 200 is shown in FIGS. 2*a*-2*c*. The antennas 212 are constructed in the form of patch antennas 212 on a piece of an appropriate transparent base 250 material, such as mylar, kapton, or polyethylene, with conductive areas made out of, but not limited to, Indium Tin Oxide (ITO) or a micro mesh of copper/aluminum/silver wires or combinations of both. Typical light absorption of such materials is less than 10%, so light passes through the antenna without apparent obstruction as seen by the casual observer. The transparent base 250 is laminated over a dielectric substrate 211 which is rigid with low RF loss properties and totally transparent. Dielectric substrates can be, but not limited to, glass, acrylic variations (Plexiglas) or polycarbonite (Lexan) sheets.

In order for the antennas to resonate, a conductive ground plane 213 is needed. This layer is constructed by similar transparent conductive materials as in 212, that is, Indium Tin Oxide (ITO) or a micro mesh of copper/aluminum/silver wires or combinations of both.

The necessary electronics are located on a narrow strip of a PCB 210 (Printed Circuit Board), typically based on FR4 with an appropriate connecting mechanism to a ground plane 213 and the patch antenna feeds on layer 212. The fabricated antenna 200 is suitable for placement on windows in a vertical fashion, and allow passage of 75%-90% ambient light through the transparent base 250 layer and other coplanar layers comprising the dielectric substrate 211 and ground plane 213 (collectively the planar antenna 240). The light passage may be adjusted as a tradeoff between optical transmissivity and electrical conductance.

Figure 3:
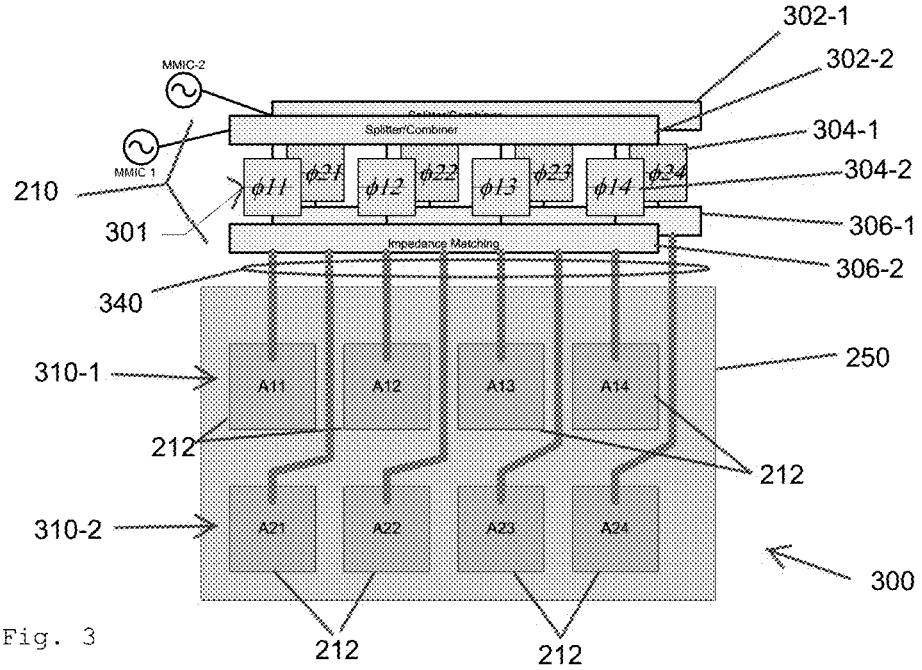
FIG. 3 shows a configuration with a driving network and steering network adjacent the transparent base.

FIG. 3 shows a configuration with a driving network and steering network adjacent the transparent base 250. To be able to steer the radiating beam of the patch antennas 212, a steering network of phase shifters is constructed; such a network has a generalized block diagram as shown 301, the splitters/combiners 302-1 . . . 302-2 (302 generally), phase shifters 304-1 . . . 304-2 (304 generally) and impedance matching elements 306-1 . . . 306-2 (306 generally) can be fabricated on the PCB 210. Alternatively, however, the phase shifter 304 may be located on the same substrate 250 as the patch antennas 212, discussed further below. Regardless, there will typically be a section of electronics on the PCB 210 which will provide equally spaced feeds and interconnects to the patch antennas 212.

In the example of FIG. 3, two phased arrays 310-1 . . . 310-2 (310 generally) are shown, with accompanying splitters 302, phase shifters 304, and impedance matching elements 306. Traces 340 connect the patch antennas 212 to the corresponding PCB 210 circuits. It is important that the traces between each array 310 and the PCB 210 driving it are the same length so that the trace length does not adversely affect the phase in order to preserve the intended steering and beamforming characteristics. The interleaved traces 340 address a potential problem that arises when more than one row of antenna patches are needed, for example to accommodate dual polarization (horizontal and vertical) in a multiple input, multiple output (MIMO) system. However, the PCB 210 is burdened with housing the entire driving network and steering network because of implementing the phase shifters on the PCB, which may make the opaque PCB 210 larger and potentially interfering with visibility around the transparent base 250.

Referring to FIGS. 1 and 3, in the approach of FIG. 3, therefore, the transparent phased antenna 300 includes a plurality of patch antennas 212 arranged on a transparent base 250, and a dielectric substrate 211 coplanar with the transparent base. Also layered is a ground plane 213 on an opposed side of the dielectric substrate from the transparent base. An interface to control electronics in the PCB 210 is provided by the traces 340, in which the control electronics 210 are adjacent to the transparent base 250 such that the transparent base, dielectric substrate and ground plane remain transparent to an observer, and ideal for placement in a window as in FIG. 1. In the approach of FIG. 3 the patch antennas 212, transparent base 250, dielectric substrate 211 and ground plane 213 therefore define the phased array antenna adapted for beamforming. The antenna 300 includes an array of patch antennas 212, discussed further below, and the plurality of traces 340 defines the interface for connecting each of the patch antennas 212 to control electronics in the PCB 210. It should be noted that the traces 340 have a length to each of the patch antennas 212 that maintains a phase of a signal sent to the patch antennas 212, as discussed further with respect to FIG. 4

Figure 4:
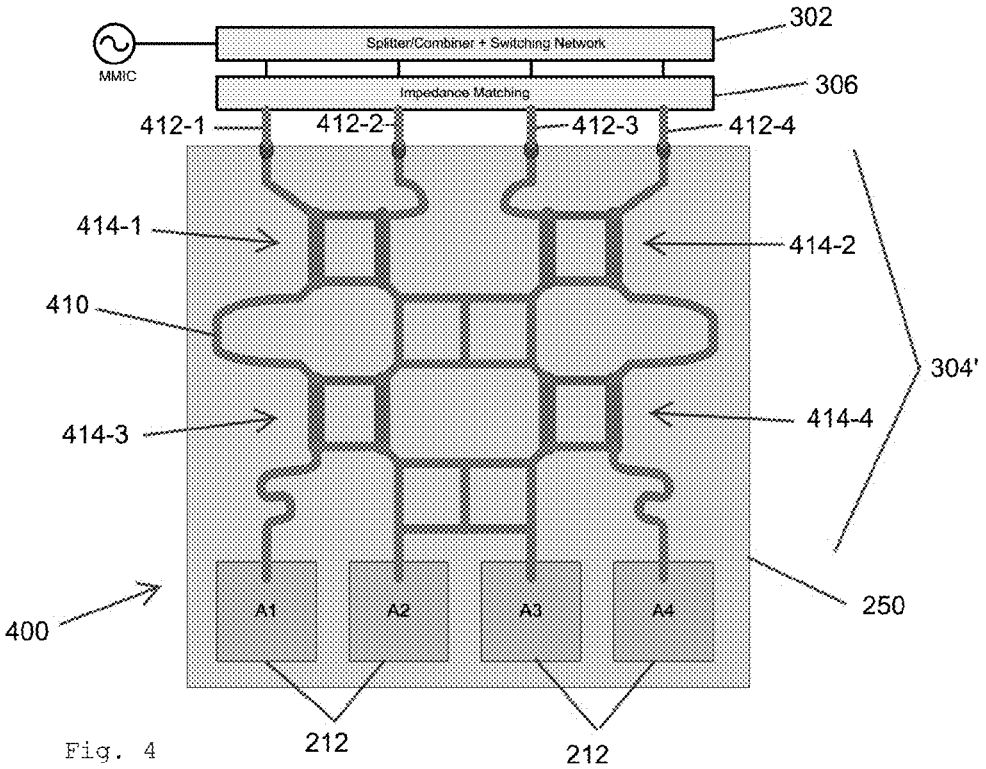
FIG. 4 shows a configuration with the steering network disposed in transparent elements on the transparent base.

FIG. 4 shows a configuration with the steering network disposed of transparent elements on the transparent base. FIG. 4 shows the transparent antenna 400 having the steering network 304' disposed on the transparent base 250 using transparent components. The splitter/combiner 302 and impedance matching 304 circuitry are disposed in the PCB 210, but the phase control is moved onto the transparent base 250, reducing the size of the PCB 210. Further, the phase control 304' circuitry defining the steering network comprises a Butler array 410, which controls phase based on which of a plurality of inputs 412-1 . . . 412-4 (412 generally) is activated. The butler array 410 employs transparent phase delays 414-1 . . . 414-4 (414 generally) instead of the more encumbering phase shifters 304 as in FIG. 3. This facilitates transparent fabrication on the transparent base 250.

In the example of FIG. 4, the plurality of traces 340 are connected to phase control elements on the transparent base (defined by the Butler array 410), and the phase control performed on the transparent base 250 for signals received from the control electronics 210. The plurality of traces 340 therefore further defines a network of traces interconnecting the control electronics 210 to the patch antennas 212. The traces have a plurality of inputs 412 such that a phase of each of the patch antennas 212 is based on selective activation of the inputs 412. The network of traces therefore includes the Butler array 410, in which the inputs of the Butler array are responsive to selective activation for determining output phase based on which of the inputs is activated.

Primary characteristics of the Butler array (matrix) are N inputs and N outputs, with N usually 4, 8 or 16, and that the inputs are isolated from each other. Phases of the N outputs are linear with respect to position, so the beam is tilted off main axis. The phase increment between the outputs depends on which input is activated, and therefore allow phase control using phase delay of the Butler array 410 rather than more extensive and complicated phase shift hardware, which would enlarge the PCB 210.

Figure 5A:
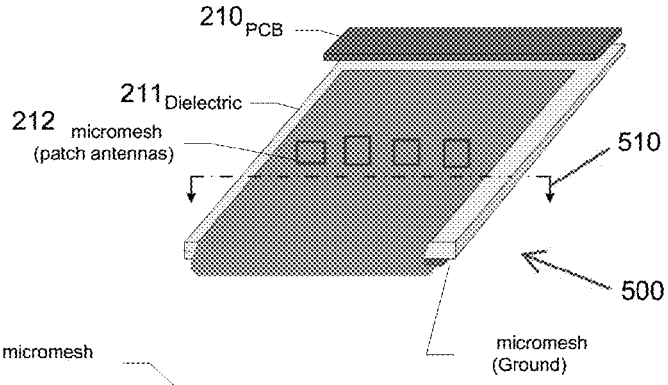
FIGS. 5*a* and 5*b* show an inverted (folded) transparent base for disposing antenna elements on coplanar portions of the transparent base.
Figure 5B:
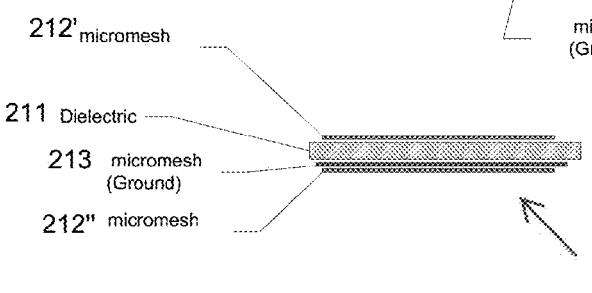

Unfortunately, combining the patches with the Butler Arrays is applicable only on a single row of patch antennas 212, because the planar nature of the Butler Array blocks the feeds to the second row of patches. Accordingly, FIGS. 5*a* and 5*b* show an inverted (folded) transparent base for disposing antenna elements on coplanar portions of the transparent base, effectively implementing multiple arrays of patch antennas 212 on a single side of the transparent base 250 and then folding the transparent base 250 around the dielectric substrate 211 and ground plane 213 layers to form multiple unobstructed phased arrays. In FIGS. 5*a* and 5*b*, the transparent base 250 includes a micromesh adapted for folding, and the ground plane 213 may be formed of a similar micromesh. The resulting cross section 510 shows the layering of the inverted transparent base as folded around the dielectric substrate 211 to form bisected portions 212' and 212" The antenna patches 212 are fabricated on piece of micromesh base material 212 as in FIG. 3, but the material is of about twice the length. The transparent base 250 is folded around the bottom edge of the substrate. 211. The transparent base 250 material is "printed" with both patch antennas 212 and Butler array shifters before folding around the dielectric substrate and ground plane. An example of the antenna base imprint of 8 horizontal elements by 2 vertical elements, including the Butler phase shifters 414 is shown in FIG. 6

Figure 6:
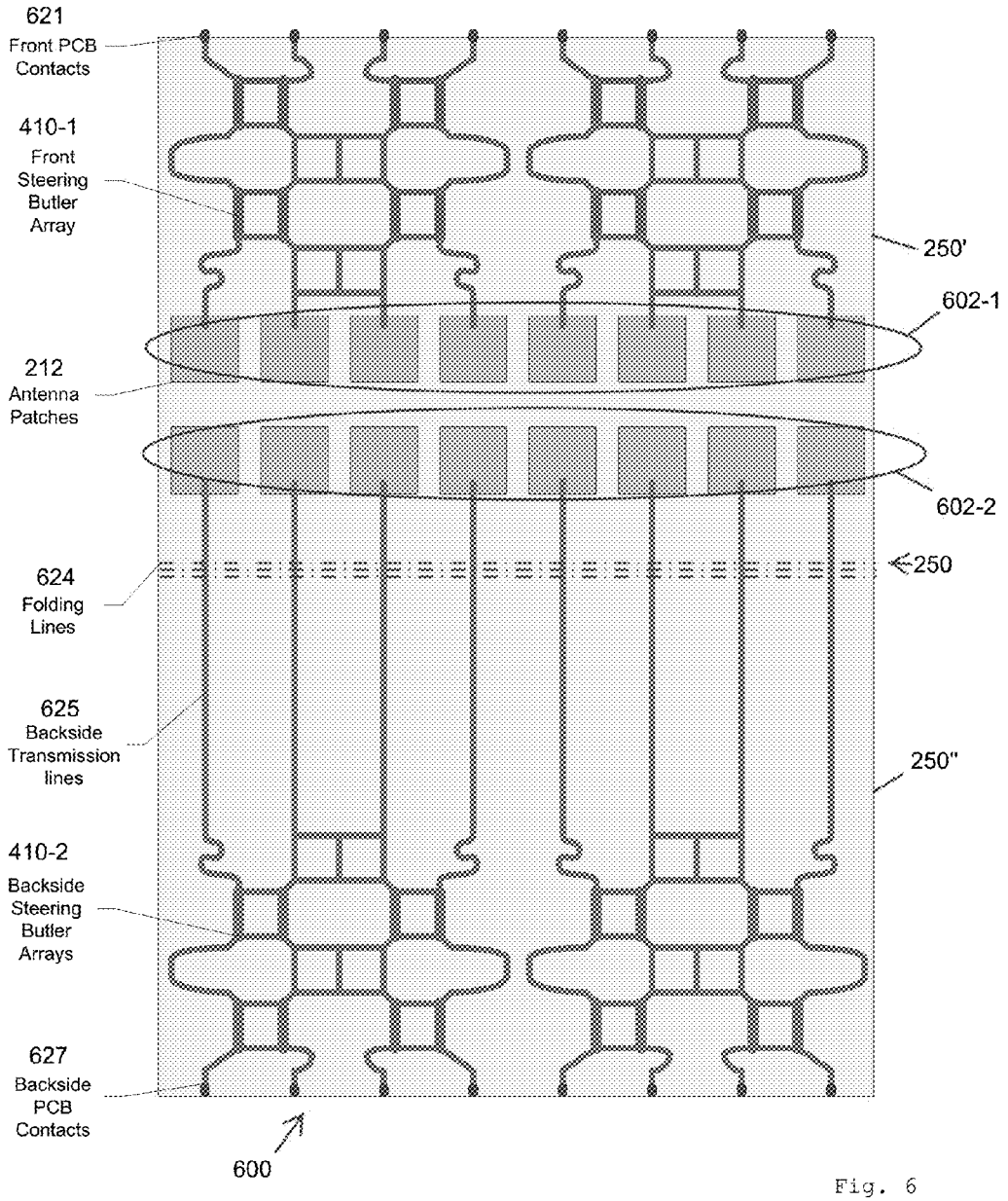
FIG. 6 shows multiple phased arrays prior to folding as in FIGS. 5*a* and 5*b*.

FIG. 6 shows multiple phased arrays prior to folding as in FIGS. 5*a* and 5*b*. Referring to FIGS. 5 and 6, a respective Butler array 410-1, 410-2 is fabricated on both portions 250', 250" of the transparent base 250 across a folding line 624. A plurality of patch antenna arrays 602-1, 602-2 (602 generally) defined by the patch antennas 212 are disposed on opposed, inverted portions 250', 250" of the transparent base 250, such that the antenna arrays coplanar for transmitting different polarizations, i.e. horizontal and vertical. The transparent base 250 may then be inverted by folding along a substantially bisecting or folding line 624 to form opposed coplanar portions 250', 250" such that each portion has a phased array 602 corresponding to a polarization orientation. In an example arrangement, separate patch elements define respective arrays for horizontally and vertically polarized signals, but there are square symmetric patches which can be simultaneously excited from two points (90 degrees apart) to produce both H & V signals at the same time. The folding line 624 bisects into two generally equal portions, however the fold may be applied for distributing other portions as long as each side of the fold maintains area sufficient to contain the phased array on the respective sides of the fold. FIG. 6 therefore demonstrates a plurality of patch antenna arrays 602, such that each of the arrays 602 is connected to the control electronics 210 and each array 602 has connections that preserve a phase of a signal transmitted from the control electronics, whether by Butler array 410 or trace distance determination.

Figure 7:
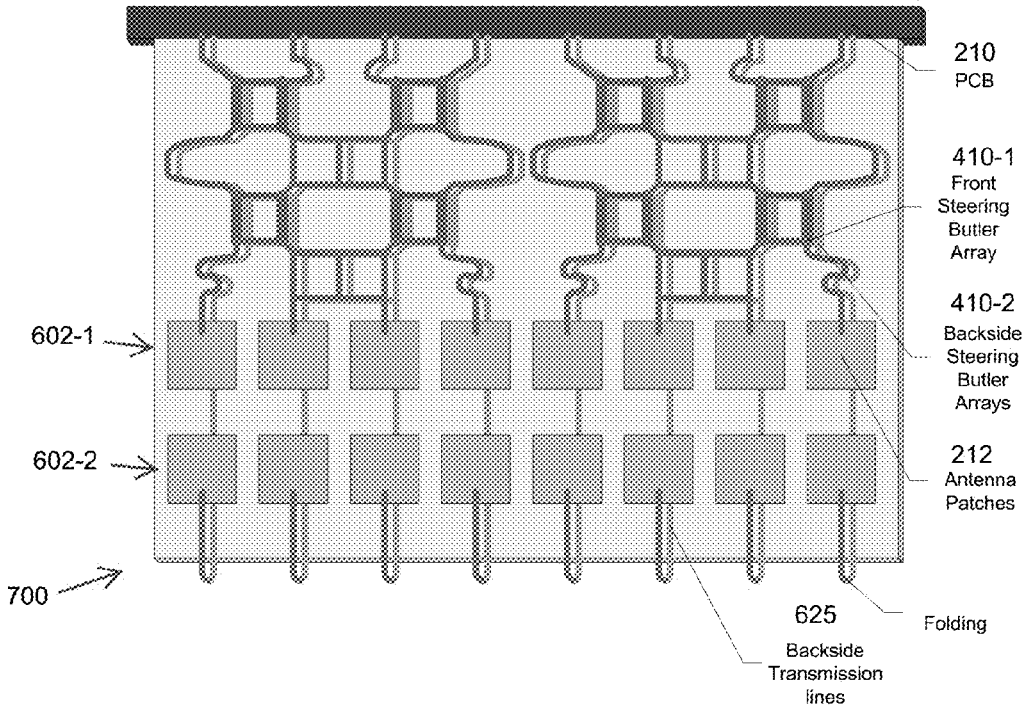
FIG. 7 shows orientation of antenna and trace elements disposed on opposed portions of a folded (inverted) transparent base as in FIGS. 5*a* and 5*b*.

FIG. 7 shows orientation of patch antenna 212 and trace elements connecting the PCB 210 to the respective arrays 602, disposed on opposed portions of the folded (inverted) transparent base 250 as in FIGS. 5*a* and 5*b*. Trace elements include front and back Butler arrays 410-1, 410-2 defining the steering network, and backside transmission lines 625 for extending across the folding line 624 of the inverted transparent base 250. The inversion is such that the patch antennas 212 are not directly opposed to each other on the opposed coplanar portions 250', 250". The antenna assembly further includes a driving network for generating the signals and a steering network (defined by the Butler array 410) for phase control to generate the phase-shifted signals at the patch antennas 212, such that the steering network is implemented on the transparent base 250 and the driving network included in the control electronics adjacent to the transparent base 250.

The example antenna 700 of FIG. 7 employs 4 MMIC (Monolithic Microwave Integrated Circuit) feeds, and an appropriate network of splitters, switches and impedance matching transformers, similar to FIG. 4. The Monolithic Microwave Integrated Circuit, or MMIC (sometimes pronounced "mimic"), is a type of integrated circuit (IC) device that operates at microwave frequencies (300 MHz to 300 GHz). Alternately, microstrip impedance matching techniques can be used to implement any needed impedance matching in the transparent area, thus performing both phase control and impedance matching on the transparent base 250 rather than the control electronics 210 on the PCB.

FIG. 7 depicts a set of four 4-element arrays which can be used with a radio supporting 4×4 MIMO. This technique can be generalized to N×4 horizontal patches with two vertical rows; since the Butler arrays can be extended to support 8-patches, the same technique can be used to drive N×8 horizontal patches with two vertical rows. Finally, by using patch elements capable of being simultaneously excited in both horizontal and vertical polarizations, the two rows of patches shown in FIG. 7 can be combined into to one row.

The example of FIG. 7 therefore depicts a method of forming a transparent phased antenna array by disposing a plurality of antennas 212 on a transparent base 250, and disposing at least one trace from an antenna control to each of the antennas 212. A dielectric substrate 211 is layered coplanar with the transparent base 250, and a ground plane 213 is then layered on an opposed side of the dielectric substrate from the transparent base to form a transparent antenna. The transparent antenna 250 assembly is then inverted or folded form opposed sides such that antennas on the transparent base are non-overlapping with antennas 212 on an opposed side of the folded transparent antenna.

The resulting transparent beamforming antenna includes a plurality of beamforming arrays 602 disposed on opposed coplanar sides 250', 250" of an inverted transparent base 250. The inverted transparent base 250 is formed from a substantially bisecting fold of a planar material, and control electronics 210 adjacent to an edge of the inverted transparent base, such that the control electronics 210 are operable for generating a phased signal. Circuit traces 340 on the inverted transparent base 250 connecting the control electronics 210 to each of the beamforming arrays 602, in which the circuit traces are arranged such that: the traces 340 are non-overlapping with other traces and the phased arrays 602 on opposed sides 250', 250" of the inverted transparent base 250, and the traces 340 have a predetermined length that preserves a phase of the phased signal sent to the phased arrays 602. Phase may be controlled either by the Butler array 410 or trace length with phase shifters.

The resulting transparent antenna is adapted for window placement as the phased arrays 602 are transparent patch antennas 212 and the circuit traces are transparent such that the inverted transparent base conveys ambient light. In an example arrangement, the transparent beamforming antenna conveys at least 90% of the ambient light striking the inverted transparent base 250 surface.

Features and advantages provided by the system, method and apparatus above include a technique to fabricate transparent patch antennas as explained in FIG. 1*a*, 1*b* and 1*c*, including a combination of a PCB and a transparent linear array of patches to allow steering of the radiation beam as shown in FIG. 3, including its extensions and alternative configurations. The disclosed approach also includes a technique to expand the number of rows of the patch antennas interleaving the feeds between rows, including the appropriate PCB driving networks. The disclosed approach incorporates the steering networks, including Butler Arrays into two row patch antennas, and minimizes the width of the PCB networks.

Those skilled in the art should readily appreciate that the antenna apparatus and associated controls as defined herein are deliverable to a networking environment in many forms, including but not limited to a) information permanently stored on non-writeable storage media such as ROM devices, b) information alterably stored on writeable non-transitory storage media such as floppy disks, magnetic tapes, CDs, RAM devices, and other magnetic and optical media, or c) information conveyed to a computer through communication media, as in an electronic network such as the Internet or telephone modem lines. The operations and methods may be implemented in a software executable object or as a set of encoded instructions for execution by a processor responsive to the instructions. Alternatively, the operations and methods disclosed herein may be embodied in whole or in part using hardware components, such as Application Specific Integrated Circuits (ASICs), Field Programmable Gate Arrays (FPGAs), state machines, controllers or other hardware components or devices, or a combination of hardware, software, and firmware components.

While the antenna apparatus as defined herein has been particularly shown and described with references to embodiments thereof, it will be understood by those skilled in the art that various changes in form and details may be made therein without departing from the scope of the invention encompassed by the appended claims.

What is claimed is:

1. A transparent phased antenna comprising:

a plurality of patch antennas folded and arranged on opposed, inverted portions of a transparent base, the plurality of patch antennas coplanar for transmitting different polarizations;

a dielectric substrate coplanar with the transparent base;

a ground plane on an opposed side of the dielectric substrate from the transparent base; and an interface to control electronics, the control electronics adjacent to the transparent base such that the transparent base, dielectric substrate and ground plane remain transparent.

2. The antenna of claim 1 wherein each portion has a phased array corresponding to a polarization orientation.

3. The antenna of claim 2 wherein the patch antennas are not directly opposed to each other on the opposed coplanar portions.

4. A transparent beamforming antenna, comprising:

multiple arrays of patch antennas on a single side of an inverted transparent base, the inverted transparent base folded around a dielectric substrate and ground plane layers to form multiple unobstructed phased arrays;

control electronics adjacent to an edge of the inverted transparent base, the control electronics for generating a phased signal;

circuit traces on the inverted transparent base, the circuit traces connecting the control electronics to each of the beamforming arrays, the circuit traces arranged such that:

the traces are non-overlapping with other traces and the phased arrays on opposed sides of the inverted transparent base; and the traces have a predetermined length that preserves a phase of the phased signal sent to the multiple arrays of patch antennas.

5. The antenna of claim 4 wherein the multiple arrays of patch antennas are transparent patch antennas and the circuit traces are transparent such that the inverted transparent base conveys ambient light.

6. The antenna of claim 4 wherein each of the transparent patch antennas convey between 75-90% of the ambient light striking the inverted transparent base surface.

* * * * *